US007237272B2

(12) United States Patent
Bötcher

(10) Patent No.: US 7,237,272 B2
(45) Date of Patent: Jul. 3, 2007

(54) PROTECTIVE CLOTHING AND FLEXIBLE MESH FROM INTERWOVEN METAL RINGS FOR PRODUCTION OF PROTECTIVE CLOTHING

(76) Inventor: Ewald Bötcher, Wildbader Strasse 120, 75179 Pforzheim (DE)

( * ) Notice: Subject to any disclaimer, the term of this patent is extended or adjusted under 35 U.S.C. 154(b) by 0 days.

(21) Appl. No.: 10/977,411

(22) Filed: Oct. 29, 2004

(65) Prior Publication Data

US 2006/0090233 A1 May 4, 2006

(51) Int. Cl.

| | |
|---|---|
| ***A41D 19/015*** | (2006.01) |
| ***A41D 27/06*** | (2006.01) |
| *F41H 1/00* | (2006.01) |
| *F41H 5/08* | (2006.01) |

(52) U.S. Cl. ..... 2/161.6; 2/162; 2/167; 2/170; 2/256; 2/255; 2/259; 2/261; 245/2; 245/5; 245/6; 245/7; 245/8

(58) Field of Classification Search ..... 2/16, 2/160, 162, 161.6, 167, 170, 255, 256, 259, 2/261, 264; 245/2, 5, 6, 7, 8

See application file for complete search history.

(56) References Cited

U.S. PATENT DOCUMENTS

| | | | | | |
|---|---|---|---|---|---|
| 2,549,847 | A * | 4/1951 | Oldofredi | 101/28 |
| 2,692,389 | A * | 10/1954 | Lamkin et al. | 2/260 |
| 2,864,091 | A * | 12/1958 | Schneider | 2/2.5 |
| 3,685,106 | A * | 8/1972 | Gandelman | 24/265 WS |
| 4,004,295 | A * | 1/1977 | Byrnes, Sr. | 2/16 |
| 4,843,650 | A * | 7/1989 | Kangas et al. | 2/16 |
| 5,054,126 | A * | 10/1991 | Rivkin | 2/16 |
| 5,088,123 | A * | 2/1992 | MacDonald | 2/162 |
| 5,113,526 | A * | 5/1992 | Wang et al. | 2/2.5 |
| 5,568,657 | A * | 10/1996 | Cordova et al. | 2/167 |
| 5,729,831 | A * | 3/1998 | Kuhlmann | 2/16 |
| 5,862,521 | A * | 1/1999 | van Marwijk et al. | 2/16 |
| 5,876,432 | A * | 3/1999 | Lau et al. | 623/1.13 |
| 5,894,602 | A * | 4/1999 | Smith et al. | 2/159 |
| 6,042,605 | A * | 3/2000 | Martin et al. | 623/1.13 |
| 6,061,833 | A * | 5/2000 | Smith et al. | 2/162 |
| 6,361,637 | B2 * | 3/2002 | Martin et al. | 156/187 |
| 6,381,753 | B1 * | 5/2002 | Smith et al. | 2/167 |
| 6,438,759 | B1 * | 8/2002 | Jaunault et al. | 2/167 |
| 6,834,797 | B2 * | 12/2004 | Gough et al. | 235/382 |

* cited by examiner

*Primary Examiner*—Robert H Muromoto

(57) ABSTRACT

A flexible mesh of interwoven metal rings for production of protective clothing is provided with one or more recesses in which an oblong stiffening element is arranged, which latter consists of a metal strap made from a spring material and is provided with holes at least along its edge, which holes are engaged by rings of the mesh that are located along the edge of the at least one recess.

23 Claims, 5 Drawing Sheets

SECTION
B - B

PROTECTIVE CLOTHING AND FLEXIBLE MESH FROM INTERWOVEN METAL RINGS FOR PRODUCTION OF PROTECTIVE CLOTHING

BACKGROUND OF THE INVENTION

The invention relates to protective clothing and flexible mesh made from interwoven metal rings for production of protective clothing.

Clothing made from interwoven metal rings is worn by persons handling tools, machines or objects that involve an especially high risk of injury, especially a risk of gashes to the body and its limbs. Typical work in areas, where such protective clothing is worn, includes meat processing activities in slaughter-houses, the poultry and fish industry. Flexible mesh of interwoven metal rings has heretofore given good results in such applications, because it offers sufficient protection from gashes and cuts and because it adapts itself readily to the human body, due to its excellent flexibility, and does not hinder movements of the body. The high degree of flexibility is achieved by the fact that the metal rings of the mesh surround each other mutually and loosely.

However, the high flexibility of such mesh material is also connected with certain disadvantages. This will become apparent, for example, from a protection for the forearm that can be fastened on a glove in the form of a cuff. If that forearm protection consists of a metal ring mesh, it will collapse and telescope in the area of the wrist, unless some stiffening is provided that prevents the cuff from collapsing or unless the forearm protection is made longer to extend over the elbow where it can be fastened by a strap wrapped around the arm.

STATE OF THE ART

It has been known from U.S. Pat. No. 4,507,353 to stiffen a metal ring mesh by bands consisting of silicon or a plastic material, with a strip of the metal ring mesh embedded in it. It is, however, a disadvantage of that solution that such silicon or plastic bands complicate the cleaning and disinfecting processes for such protective clothing. This is a disadvantage especially in applications in the foodstuff industry. In addition, such silicon or plastic bands are subject to heavy wear and abrasion in practical use.

A protective glove made from a metal ring mesh and provided with a cuff with interwoven spiral springs has been known from U.S. Pat. No. 5,088,123 A. Production of such a glove is complex. The spiral springs add thickness to the cuff and render cleaning difficult, which is undesirable. The ends of the spiral spring can be hidden only with difficulty and provide a risk of injury.

GB 2 275 174 A discloses a protective glove having a cuff made from a metal ring mesh, in which pockets are formed that receive an oblong, flat, wave-shaped spring made from spring steel. Such a protective glove is complicated to produce and consists in its stiffened area of three, instead of one, superimposed layers which extremely complicates cleaning of the glove and increases its weight.

German Utility Patent G 91 13 608.3 discloses a protective glove, made from a metal ring mesh, with a cuff formed completely or partially from a set of rigid plates arranged around the arm and connected one with the other by individual rings independent of the metal ring mesh. Such a cuff is, however, uncomfortable and its poor adaptation to the arm becomes worse as the length of the plates increases so that longer cuffs require the use of a plurality of plates in series.

US 2004/0031079 A1 discloses a mesh for protective clothing consisting of metal rings, which is stiffened by welding or soldering together interlinked rings in partial areas of the mesh. This permits, for example, protective gloves with stiffened cuffs to be formed that offer increased comfort to the wearer and can be cleaned as easily as mesh without any stiffening. It is, however, a drawback of that system that the welding points existing between the welded rings are only small. This is connected with the risk that the number of welding points and, thus, the rigidity of the mesh will decrease over time as a result of use of the protective clothing.

U.S. Pat. No. 5,729,831 A discloses a protective glove with a cuff made from a metal ring mesh. The cuff is provided with a longitudinal slot and is stiffened along the edge of the slot by a silicon band passing through the mesh. Stiffening the material by means of a silicon band is connected with the same disadvantages as those indicated above in connection with U.S. Pat. No. 4,507,353. Two closing straps, made from the metal ring mesh, are provided on the edge of the slot, with a closure element attached to each of the straps, the closure elements comprising claws by means of which they can be hooked into the metal ring mesh.

SUMMARY OF THE INVENTION

The object of the present invention is to provide a metal ring mesh, stiffened in places, from which protective clothing, especially gloves, can be formed that offer high comfort to the wearer, can be produced at low cost and are easy to clean.

This object is achieved by a flexible mesh of interwoven metal rings for production of protective clothing, which is provided with one or more recesses in which an oblong stiffening element is arranged, which latter consists of a metal strap made from a spring material and provided with holes at least along its edge, which holes can be engaged by rings of the mesh that are located along the edge of the at least one recess.

The object is further achieved by a protective clothing made from the flexible mesh of interwoven metal rings and comprising one or more recesses in which an oblong stiffening element is arranged, which latter consists of a metal strap made from a spring material and provided with holes at least along its edge, which holes can be engaged by rings of the mesh located along the edge of the at least one recess.

The invention offers essential advantages:

- The stiffening element can be, and preferably is, thinner than the flexible mesh with the at least one recess in which the stiffening element is fitted.
- Instead of increasing the weight of the flexible mesh or of the protective clothing produced therefrom, the stiffening element may even reduce the weight of the mesh and of the protective clothing produced therefrom.
- The stiffening element can be cleaned at least as easily as the flexible mesh in which the stiffening element is fitted.
- The stiffening element can be given any desired length. In the case of an arm protection, that may be attached to a glove, the stiffening element may extend from the wrist to the other end of the arm protection and may perfectly stabilize the latter over its length.
- The stiffening element is subject to less wear, therefore offering long service life.

Since the stiffening element consists of a metallic strap, it can be labeled permanently, especially by embossing or engraving techniques. Such labeling will not get lost by cleaning operations.

The use of a stiffening element made from metal allows production of protective clothing consisting exclusively of metal, for example of stainless steel, titanium or a titanium alloy. This is an advantage especially for applications in the foodstuff industry, where special demands are placed on hygiene.

A glove with a cuff, with a stiffening element in the form of a metal strap made from a spring material fitted in the cuff, can be turned inside out due to the spring resilience of the stiffening elements so that it can be worn optionally on the right and on the left hand.

By interlinking the edge of each stiffening element with rings from the mesh located on the edge of a recess in the mesh, which preferably runs around the entire edge of the stiffening element, the stiffening element cannot possibly hurt the wearer's skin and there is no risk that the edge of the stiffening element may get caught by some object or other during work.

In order to permit the stiffening element to be optimally fitted in the mesh formed from rings, the stiffening elements are provided with holes, preferably along their entire outer edge. Further holes may be provided in that area of the stiffening element, which is enclosed by holes provided along its edge, which further holes, by their number and arrangement, may have a favorable influence on the weight, the flexibility and ventilation of the wearer's skin. Preferably, the respective stiffening element is linked with all rings that form the edge of the at least one recess in the ring mesh in which the stiffening element is fitted. One thereby achieves especially intimate, optimum linking between the stiffening element and the flexible mesh. To this end, the holes provided on the outer edge of the stiffening element are conveniently arranged and adapted to the structure of the flexible mesh so that each hole on the outer edge of the stiffening element can be engaged, and indeed is engaged, by one ring of the mesh.

The oblong stiffening elements have lengthwise edges that preferably extend in parallel one to the other, which makes them especially well suited for stabilizing the length of the flexible mesh in a given direction. The holes intended for interlinking with the rings of the flexible mesh, which holes are identical in diameter, are arranged on the lengthwise edges of that stiffening element, conveniently at regular spacing, the centre spacing of the holes preferably being approximately identical to the outer diameter of the rings so that the rings and the holes are arranged in a modular pattern optimally matching each other.

Stiffening elements having a width of between 1.5 cm and 3 cm, especially between 1.8 cm and 2.5 cm, are especially well suited. Stiffening elements of that width offer high wearing comfort of a forearm protection, for example a cuff on a glove. A plurality of such stiffening elements may be arranged around the arm in the longitudinal direction of the forearm protection, in which case a strip of the metal ring mesh should remain between every two stiffening elements. A glove comprising a forearm protection of that kind also can be turned inside out.

It is further an advantage in terms of wearing comfort if at least one of the two ends of the stiffening element is rounded. In the case of a forearm protection, for example a cuff on a glove, at least the end of the stiffening element near the wrist should be rounded.

In known mesh material formed from metal rings the rings generally consist of stainless steel or of titanium. These materials are also suited for purposes of the present invention. In mesh materials according to the invention, the stiffening elements preferably consist of stainless steel or of a superelastic alloy. Especially well suited for stiffening elements made from stainless steel is a spring-steel band material having a tensile strength of 1900 $mm^2$ to 2100 $N/mm^2$, for example the steel DIN No. 1.4310, with a thickness of 0.3 mm. A superelastic alloy especially well suited is Nitinol, an alloy that consists of nickel and titanium in approximately equal parts and that shows superelasticity in a selectable temperature range and shape memory in another temperature range.

The invention is especially well suited for flexible mesh which has a top side and an underside, and is built up from lines of rings arranged one beside the other with each line, that does not form an edge of the mesh, being enclosed between a first adjacent line of rings on the one side and a second adjacent line of rings on the other side, and each ring of a line, that is not located on an edge of the mesh, engaging in two adjacent rings of the first adjacent line from the top and in two adjacent rings of the second adjacent line from the bottom. The rings in one line do not, however, engage in rings in the same line. The mesh therefore shows a zigzag pattern between the top side and the underside in transverse direction to the lines, with the effect that the stiffening elements fitted in the recesses of the mesh are located between its top side and its underside, which prevents the stiffening elements from digging their edge into the skin of a person wearing the mesh. This situation does not change even if a glove made according to the invention is turned inside out. Due to the described line-by-line structure the mesh can be pushed together to a considerable greater degree in a direction transverse to the direction of the lines than in the direction of the lines. The direction of the lines is also known as grain direction. The oblong stiffening elements are fitted in the mesh preferably transversely to the grain direction of the mesh, i.e. parallel to the ring lines.

The invention is suited for stiffening protective clothing for different purposes, for example for stiffening aprons, especially however for stiffening protective gloves provided with a cuff. In that case one or more stiffening elements are fitted in an identical number of recesses of the metal ring mesh forming the cuff, preferably from the area of the wrist up to rear end of the cuff, or to a point near the rear end of the cuff.

CONCISE DESCRIPTION OF THE DRAWINGS

DETAILED DESCRIPTION OF THE DRAWINGS

Figure 1:
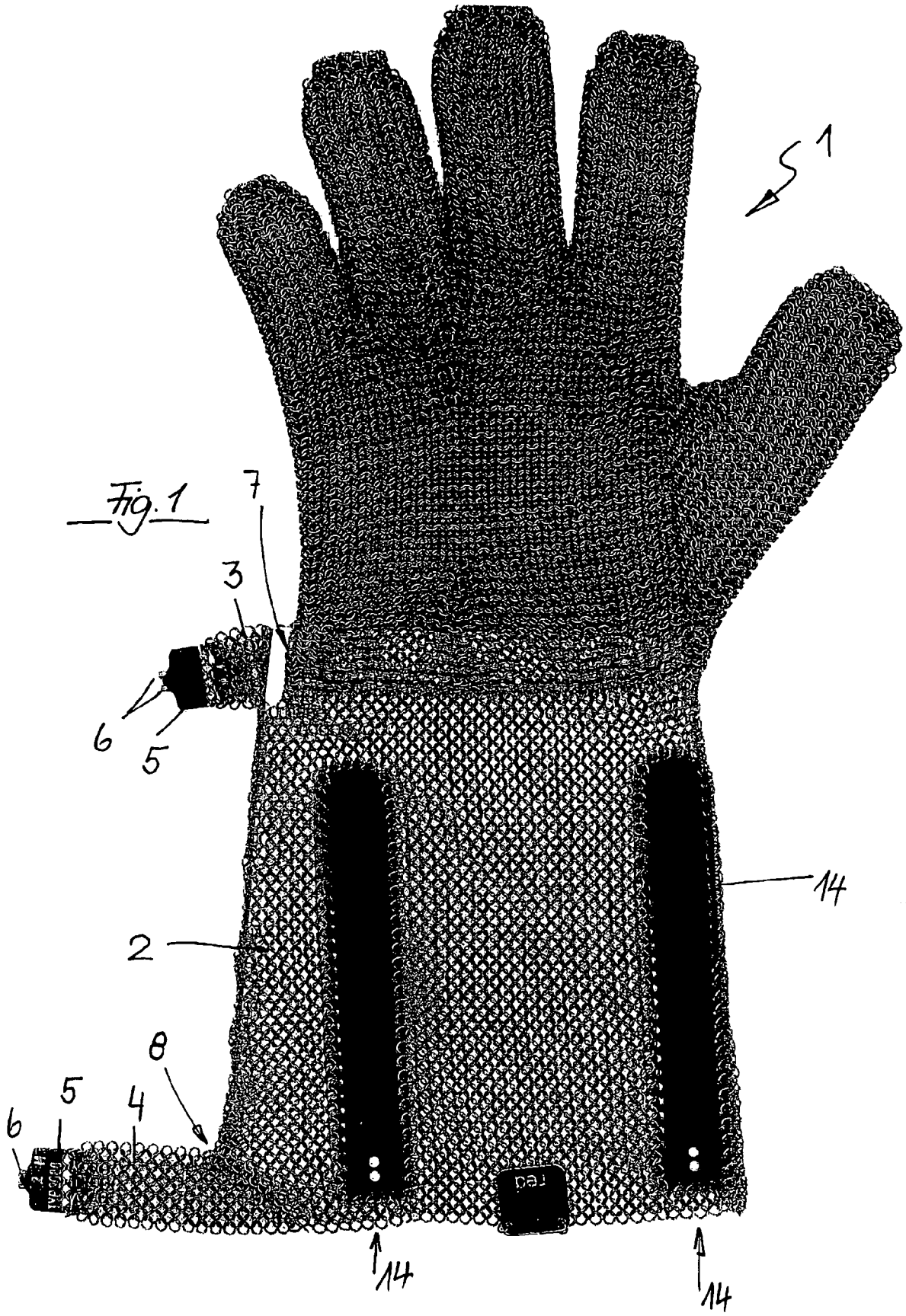
FIG. 1 shows a protective glove with a cuff in which a plurality of stiffening elements are provided.
Figure 2:
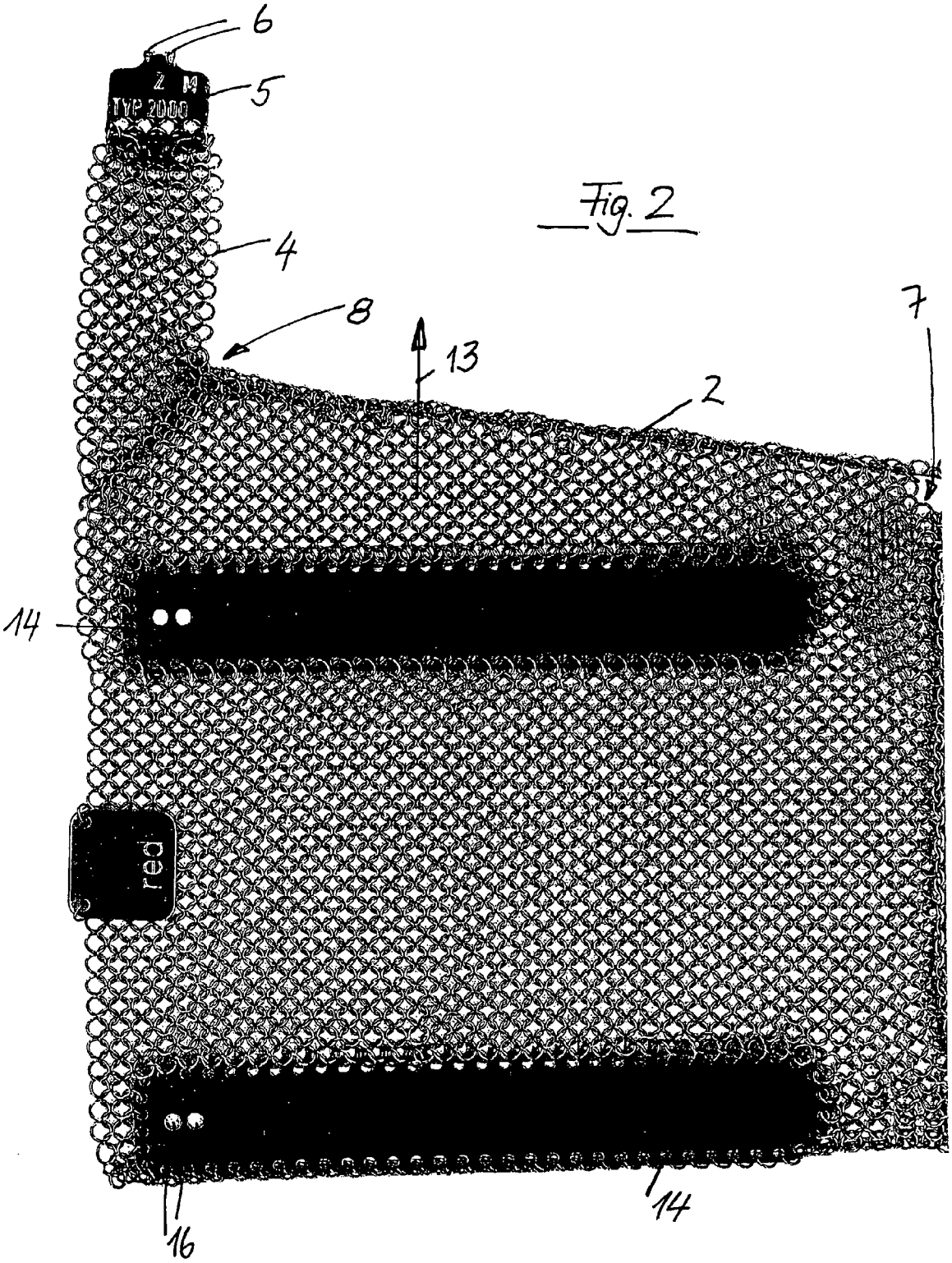
FIG. 2 shows a cuff of a glove according to FIG. 1 in enlarged scale.

The glove 1 illustrated in FIGS. 1 and 2 consists of a flexible mesh made from loosely interlinked metal rings. The glove 1 comprises a cuff 2 that serves to protect a person's forearm. The two ends of the cuff 2 are provided, in the area of the lateral side of the hand, with fastening straps 3 and 4 consisting of the metal ring mesh, with each of the straps carrying on its end a closure element 5 provided with hooks 6. The fastening straps 3 and 4 bridge two slots 7 and 8 provided in the metal ring mesh of the cuff 2, which slots serve to facilitate the process of putting on the glove 1. By tightening the fastening straps 3 and 4 and hooking the closure element 5 into the metal ring mesh the glove 1 can be applied tightly to the person's arm in the area of the wrist and at the rear end of the cuff 2.

The basic structure of a glove of that kind is disclosed in U.S. Pat. No. 5,729,831 A, to which express reference is herewith made with the intention to incorporate the disclosure of U.S. Pat. No. 5,729,831 A in the present application.

Figure 4:
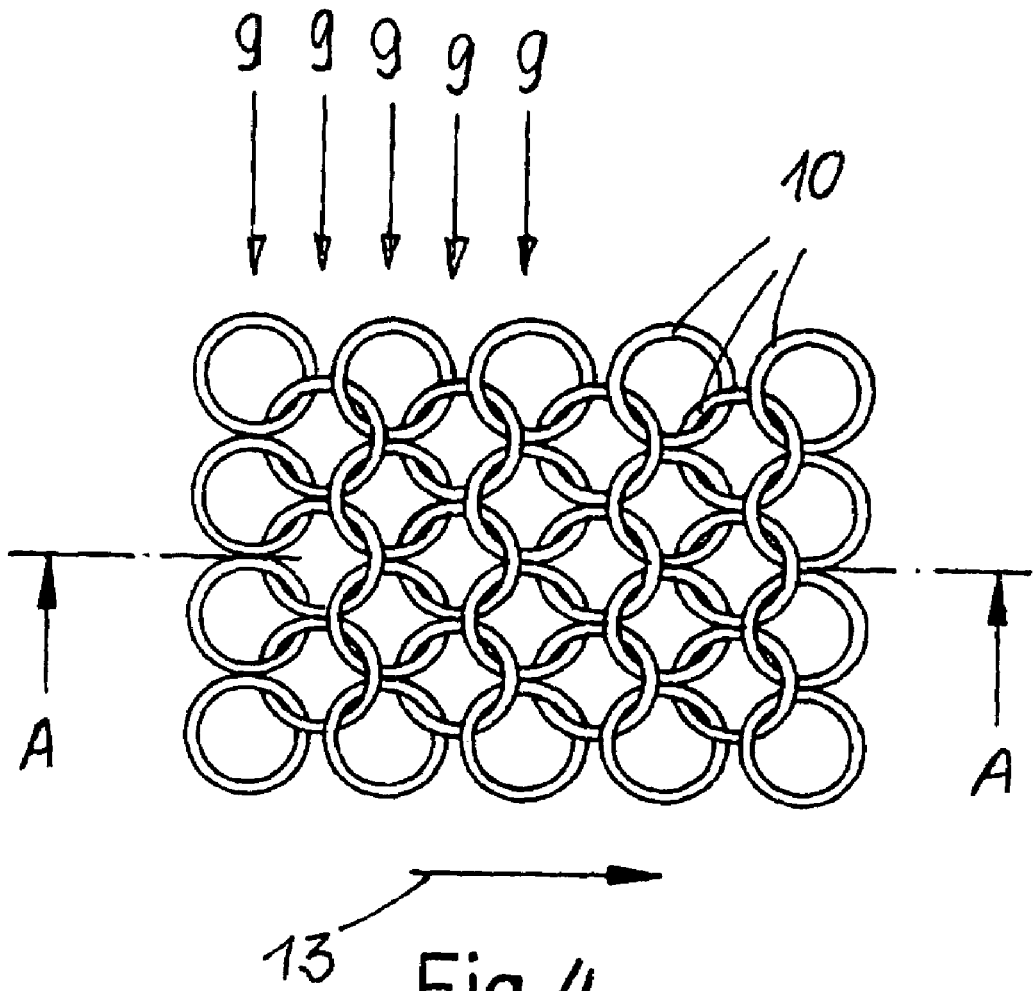
FIG. 4 shows a top view the structure of the flexible mesh of the protective glove, as a detail and in greatly enlarged scale.
Figure 6:
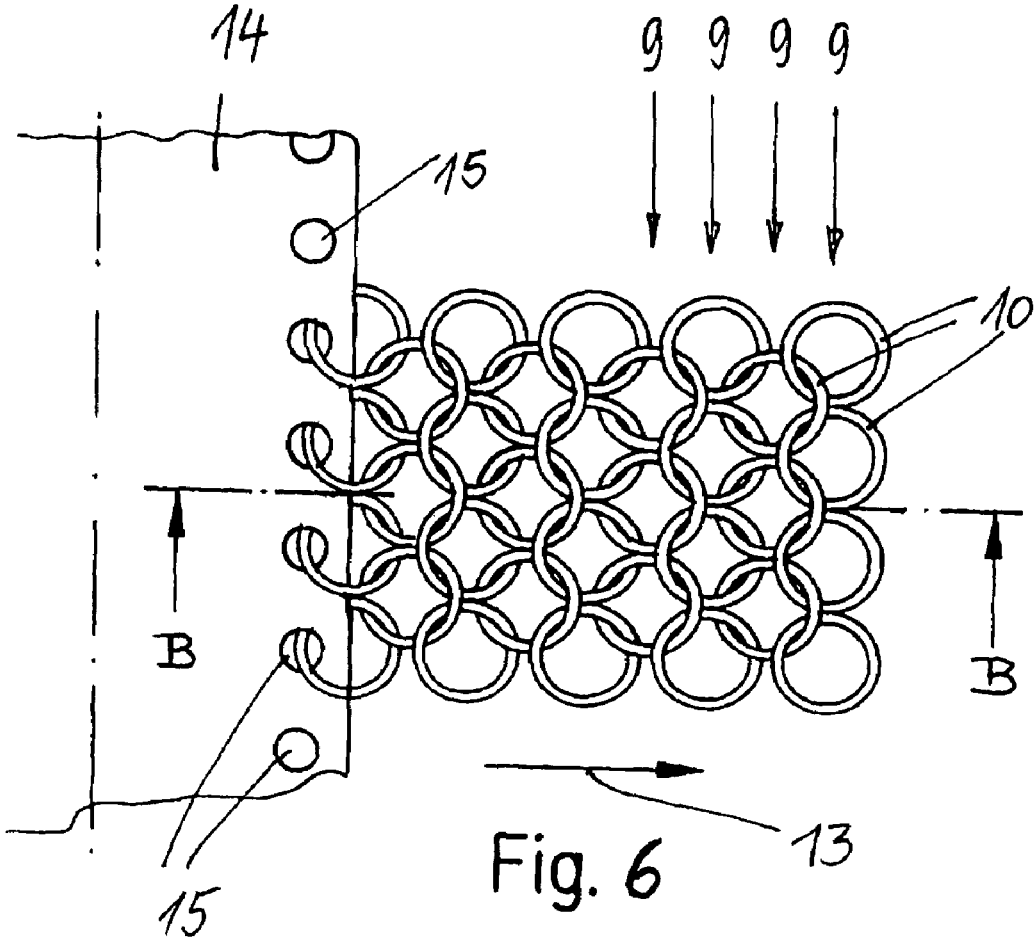
FIG. 6 shows a cross-section of a detail of the mesh illustrated in FIG. 4, in parallel to the grain direction of the mesh.

The structure of the metal ring mesh of the glove 1, including its cuff 2 and the fastening straps 3 and 4, is shown in FIG. 4. The mesh is built up from lines 9 of rings 10 arranged one beside the other, each line 9, that does not form an edge of the mesh, being enclosed by a first adjacent line 9 on its one side and a second adjacent line 9 of rings 10 on its other side. Each ring 10 of a line 9, that is not positioned on the edge of the mesh, engages in two mutually adjacent rings 10 of the first adjacent line from the top side 11 of the mesh and in two mutually adjacent rings 10 of the second adjacent line from the underside 12 of the mesh. Apart from edges and seams, each ring 10 in the mesh is linked with four adjacent rings 10. The mesh can be pushed together in a direction at right angles to the lines 9. In the opposite direction 13, it can be stretched without becoming narrower. The opposite direction 13 is also known as "grain direction" of the mesh. The particular kind of linking of the rings 10 gives the cross-section of the mesh, parallel to the grain direction 13, the zigzag pattern illustrated in FIG. 6.

Figure 3:
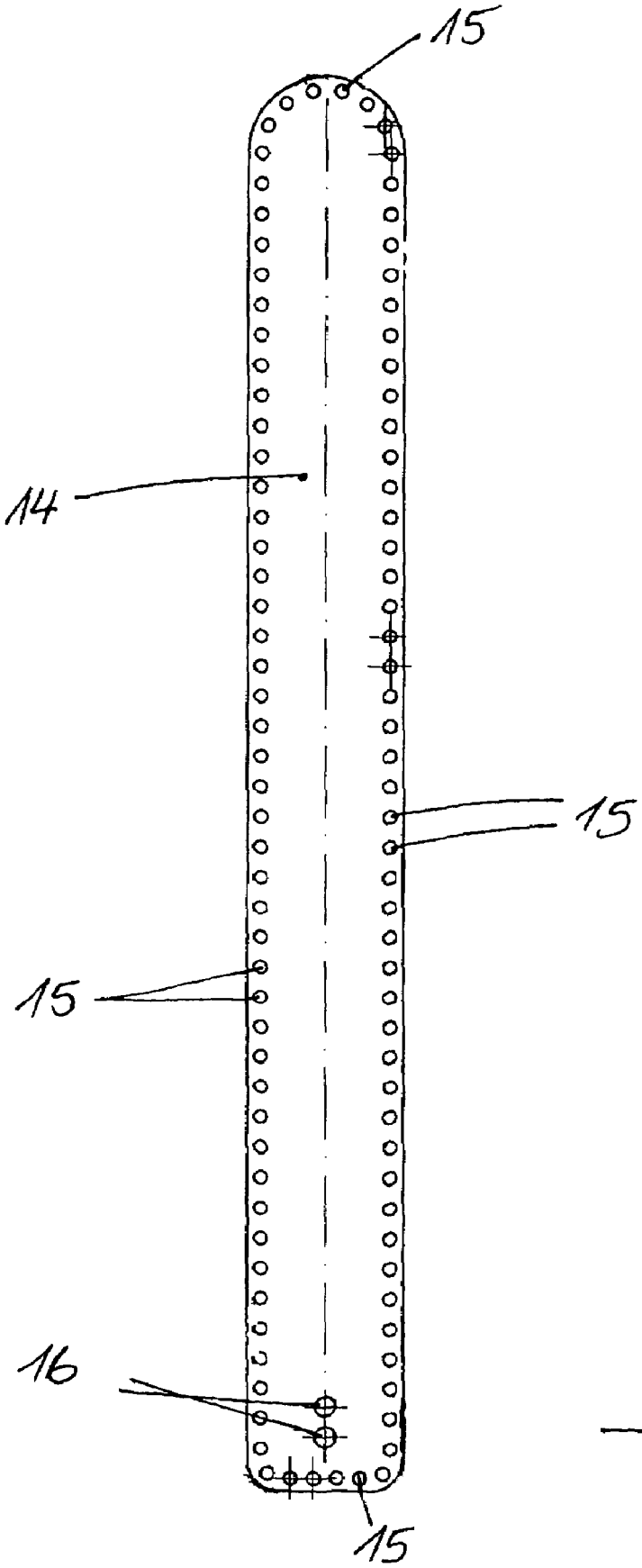
FIG. 3 shows a top view of a stiffening element, as a detail.

FIGS. 1 and 2 show that a plurality of stiffening elements 14 are arranged in the cuff, extending from the wrist area of the cuff 2 to a point near the rear end of the cuff. A top view of such a stiffening element 14 is shown in FIG. 3. The stiffening elements 14 consist of metal straps made from spring material, especially a spring-steel band material. The straps have parallel lengthwise edges and are rounded on both ends. The stiffening elements 14 are provided near their edge with holes 15 arranged along the entire circumference of the stiffening elements 14 at regular spacings that correspond to the center spacings of the rings 10 in the metal mesh.

The stiffening elements 14 are fitted in matching recesses in the metal ring mesh. Each ring 14 located on the edge of such a recess passes through one of the holes 15 and at the same time through two adjacent rings 10 of the metal ring mesh.

On the two lengthwise edges of the stiffening element 14 it is the rings 10 of a single line 9 that pass through the holes 15.

Each of the rings 10, passing through the holes 15, engages additionally two rings 10 of the adjacent line 9 that does not form the edge of the recess. At the rounded ends of the stiffening elements 14, the rings engaging the holes 15 are not the rings of a single line, but rather rings 10 of different lines 9, namely of those lines that are crosses by the edge of the stiffening elements 14.

In the area of the rear end of the stiffening elements 14 two further holes 16 are provided in that element, in which a closure element 5 provided on the rear fastening strap 4 can be engaged by its hooks 6. The rest of the stiffening elements 14 is not provided with holes and, consequently, can be labeled, for example with a model designation, a size, an order number and/or a mark.

Figure 5:
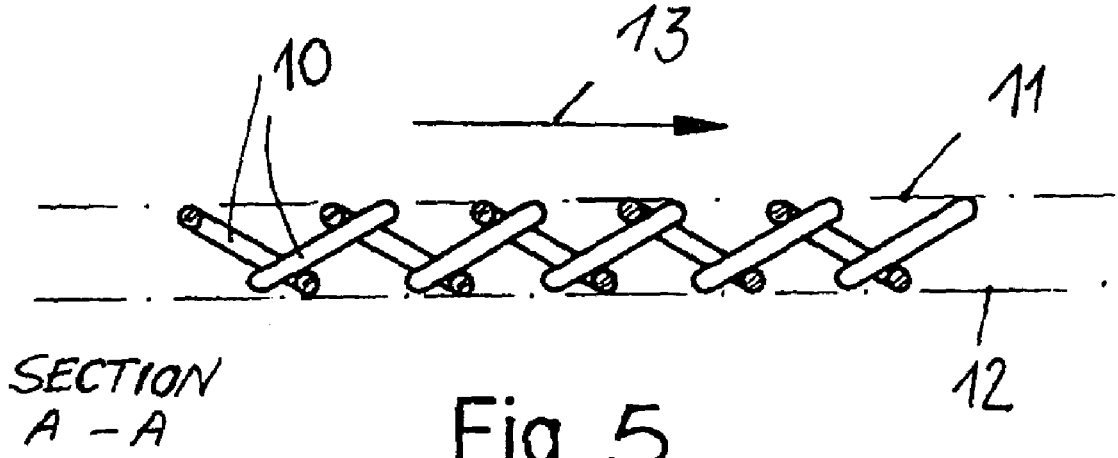
FIG. 5 shows a detail of the mesh of FIG. 4, in combination with a section of a stiffening element.
Figure 7:
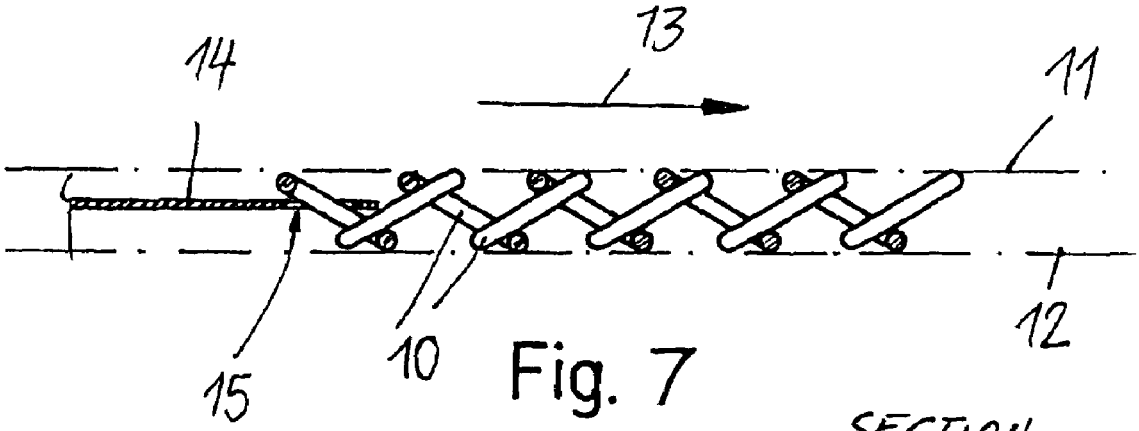
FIG. 7 shows a cross-section through a detail of the mesh according to FIG. 6, in combination with a cross-section through a portion of the stiffening element.

The realization of the interlinking between the metal ring mesh and the stiffening element 14 is illustrated in detail in FIGS. 5 and 7. From FIG. 7 it appears that the stiffening element is arranged between the top side 11 and the underside 12 of the metal ring mesh so that the edge of the stiffening element 14 is well protected within the metal ring mesh and will not irritate the skin of the person wearing the glove. In order to guarantee the desired flexibility and adaptability to the contour of the forearm, the stiffening element has a thickness of a few tenths of a millimeter only, preferably of 0.3 mm. Due to the position of the stiffening element 14 between the top side 11 and the underside 12 of the metal ring mesh, and due to the elastic quality of the stiffening elements 14, the glove 1 can be turned inside out so that it can be worn optionally on the right hand and on the left hand.

LIST OF REFERENCE NUMERALS

1. Glove
2. Cuff
3. Fastening strap
4. Fastening strap
5. Closure element
6. Hook
7. Slots
8. Slots
9. Line
10. Rings
11. Top side
12. Underside
13. Opposite direction, grain direction of the mesh
14. Stiffening element
15. Holes on the edge of 14
16. Additional holes

The invention claimed is:

1. Protective glove with a cuff made from a flexible mesh of interwoven metal rings, wherein the cuff has a longitudinal direction and one or more recesses extending in the longitudinal direction, with a flat-oblong stiffening element arranged in each recess, said stiffening element comprises a metal strap made from a spring-metal band material and is provided with holes at least along its edge, said holes are engaged by rings of the mesh that form the edge of the at least one recess, wherein the cuff comprises a plurality of stiffening elements arranged in parallel one to the other, with a strip of the flexible metal ring mesh remaining between every two stiffening elements.

2. The protective glove as defined in claim 1, wherein the at least one stiffening element extends over the entire length or almost the entire length of the cuff.

3. The protective glove as defined in claim 1, wherein the stiffening elements are narrower than the strips of the metal ring mesh arranged between them.

4. The protective glove as defined in claim 1, having a closure element equipped with claws and wherein at least one stiffening element has additional holes, which are not arranged on the edge of the stiffening element and which can be engaged by the claws of the closure element.

5. The protective glove as defined in claim 1, wherein the at least on recess of the mesh surrounds the entire circumference of the stiffening element arranged in the recess.

6. The protective glove as defined in claim 1, wherein the stiffening element is connected with all rings that form the edge of the at least one recess in which the stiffening element is located.

7. The protective glove as defined in claim 1, wherein the stiffening element is provided with holes along its entire outer edge.

8. The protective glove as defined in claim 1, wherein each hole provided on the outer edge of the stiffening element is engaged by one ring of the mesh.

9. The protective glove as defined in claim 1, wherein the oblong stiffening elements have parallel longitudinal edges.

10. The protective glove as defined in claim 1, wherein the rings are identical in diameter.

11. The protective glove as defined in claim 9, wherein the holes on the lengthwise edges of that stiffening element are arranged at regular spacings, the center spacing of the holes being approximately Identical to the outer diameter of the rings.

12. The protective glove as defined in claim 1, wherein the stiffening elements have a width of between 1.5 cm and 3 cm.

13. The protective glove as defined in claim 1, wherein the stiffening elements have a width of between 1.8 cm and 2.5 cm.

14. The protective glove as defined in claim 1, wherein the stiffening element has two ends with at least one end being rounded.

15. The protective glove as defined in claim 1, wherein the stiffening element consists of a stainless steel.

16. The protective glove as defined in claim 1, wherein the stiffening element has a tensile strength of 1900 $mm^2$ to 2100 $N/mm^2$.

17. The protective glove as defined in claim 1, wherein the stiffening elements consist of a superelastic alloy.

18. The protective glove as defined in claim 17, wherein the stiffening elements consist of Nitinol.

19. The protective glove as defined in claim 1, wherein the stiffening element is labeled by embossing or engraving.

20. The protective glove as defined in claim 1, wherein each ring that engages in a hole on the edge of the stiffening element simultaneously engages in two adjacent rings of the mesh.

21. The protective glove as defined in claim 1, having a top side and an underside and being built up from lines of rings arranged one beside the other, with each line, that does not form an edge of the mesh, being enclosed between a first adjacent line of rings on the one side and a second adjacent line of rings on the other side, and each ring of the line, that is not located on an edge of the mesh, engaging in two adjacent rings of the first adjacent line from the top and in two adjacent rings of the second adjacent line from the bottom.

22. The protective glove as defined in claim 21, wherein the stiffening elements are arranged in parallel to the lines of the mesh.

23. The protective glove as defined in claim 10, wherein the holes on the lengthwise edges of that stiffening element are arranged at regular spacings, the center spacing of the holes being approximately Identical to the outer diameter of the rings.

* * * * *